United States Patent [19]

Horian

[11] 4,247,002

[45] Jan. 27, 1981

[54] ANTISTATIC RECORD ENVELOPE

[76] Inventor: Richard C. Horian, 100 Magnolia Lake Ct. Sweetwater Club, Longwood, Fla. 32750

[21] Appl. No.: 870,962

[22] Filed: Jan. 19, 1978

Related U.S. Application Data

[63] Continuation-in-part of Ser. No. 845,509, Oct. 25, 1977, abandoned.

[51] Int. Cl.[3] ..... B65D 85/57

[52] U.S. Cl. ..... 206/313; 361/212; 206/312; 229/62; 150/3

[58] Field of Search ..... 361/212, 215; 206/309, 206/311, 312, 313, 523; 229/62; 150/3

[56] References Cited

U.S. PATENT DOCUMENTS

| | | | |
|---|---|---|---|
| 1,490,712 | 4/1924 | Rudge | 206/313 |
| 3,009,707 | 11/1961 | Schulein | 206/312 |
| 3,166,688 | 1/1965 | Rowand et al. | 361/215 |
| 3,380,481 | 4/1968 | Kraus | 150/3 |
| 3,473,087 | 10/1969 | Slade | 361/215 |
| 3,731,794 | 5/1973 | Garrod | 206/313 |
| 3,774,757 | 11/1973 | Harris et al. | 361/212 |
| 3,963,856 | 6/1976 | Carlson | 361/215 |

FOREIGN PATENT DOCUMENTS

| | | | |
|---|---|---|---|
| 7746356 | 11/1966 | Canada | 206/312 |
| 1164422 | 10/1958 | France | 206/312 |

*Primary Examiner*—Herbert F. Ross

*Attorney, Agent, or Firm*—Reising, Ethington, Barnard, Perry & Brooks

[57] ABSTRACT

An antistatic phonograph record envelope for storing records in a cardboard jacket is made from extruded plastic film having a thickness between about 1 and 6 mils with an antistatic agent extruded within the film. Layers of the plastic film have one or more seams providing a closed end and sides while an open end of the envelope has an elongated slit through which the record is inserted into the envelope for storage and pulled out of the envelope for use. The antistatic agent in the plastic film layers prevents the buildup of static electricity on the record as it is inserted into and pulled out of the envelope and also dissipates any accumulated static electricity on the record during storage within the envelope. At the open end, the plastic layers preferably have cooperable projections that are snapped into engagement with each other to provide a seal for the envelope. A flap at the open end of the envelope projects out of a square cardboard record jacket with the envelope and a stored record inserted therein so as to facilitate removal of the envelope from the jacket.

3 Claims, 7 Drawing Figures

ANTISTATIC RECORD ENVELOPE

This application is a continuation-in-part of my copending U.S. patent application Ser. No. 845,509, filed Oct. 25, 1977, now abandoned, the entire disclosure of which is hereby incorporated by reference.

TECHNICAL FIELD

This invention relates to a phonograph record envelope for storing a phonograph record.

BACKGROUND ART

Phonograph records are conventionally sold within cardboard storage jackets of square shapes having two cardboard pieces joined at three edges and open at a fourth edge to permit the record to be inserted into and pulled out of the jacket through an elongated slit. The cardobard is of a sufficient thickness to help prevent record breakage during the storage. Before being inserted into the jacket, the record is first inserted into an envelope or sleeve that also has only one open edge. By inserting the record with the open envelope edge positioned alongside one of the closed jacket edges, the stored record is enclosed so as to prevent atmospheric dust from accumulating on it. Paper or ordinary plastic film is normally used to make the storage envelope which is much more flexible than the cardboard jacket. Use of the envelope also eliminates wear on the record surfaces during insertion into the jacket and as the record is pulled out of the envelope. Since the envelope is much more flexible than the jacket, the envelope can be opened in a manner that permits record insertion with very little, if any, wear.

Paper and ordinary plastic film record envelopes create a static electrical charge on the record as it is inserted into or pulled out of the envelope. The charge created is greater for plastic film envelopes than for paper envelopes. However, paper envelopes tend to deposit pulp particles onto the record. Static electrical charge on the record retains the pulp particles as well as attracting dust accumulation from the atmosphere as the record is being used. Any static electrical charge on the record either due to its insertion into and pulling out of the envelope or due to any charge accumulated during use is usually concentrated in what is known as "hot spots" which attract and retain the greatest amount of the accumulation. During storage, neither the paper nor the ordinary plactic film envelope dissipate any of the accumulated static electricity on the record. Tests have shown that the static electrical charges which accumulate on the record can reach 8,000 volts or more. This high voltage collects and retains the paper particles and the dust which cause accelerated record wear during use as well as a loss of the record fidelity.

DISCLOSURE OF THE INVENTION

An object of the present invention is to provide an improved record envelope which dissipates any static electrical charge that may accumulate on the record during use and which also prevents the buildup of any static electrical charge during insertion of the record into the envelope or as the record is pulled out of the envelope as well as providing the usual function of protecting the record against wear during movement into and out of a cardboard storage jacket.

In carrying out the above object, this invention provides an antistatic phonograph record envelope made from an extruded plastic film with an internal antistatic agent extruded between the film surfaces. The film has a thickness between about 1 to 6 mils with 2 mils being the most preferred thickness for economy of the plastic material required while still being able to easily handle the material. Two layers of the plastic film are joined by at least one seam therebetween and form a closed end and closed sides at which the layers are connected. An open end of the envelope includes a slit that extends between the closed sides to permit the insertion of the record into the envelope for storage and pulling of the record out of the envelope for use. During such movement into and out of the envelope through the elongated slit at its open end, the internal antistatic agent in the plastic film layers prevents the buildup of any static electrical charge on the record. Any static electrical charge which has accumulated on the record during use is dissipated by the internal antistatic agent in the plastic layers during storage within the envelope so that the record will not have the tendency to pick up atmospheric dust during subsequent use.

At its open end one embodiment of the envelope has projections on the layers that provide a seal upon being snapped into engagement with each other. Disengagement of the projections allows the record to be pulled out of the envelope. At its closed end the envelope has a semicircular shape. The maximum distance between the open and closed ends of the envelope is slightly greater than the distance between its sides. Upon insertion of the envelope into a square cardboard record jacket, a flap of the envelope at its open end sticks out of the jacket while inserted thereinto with a record stored in the envelope. The flap facilitates removal of the envelope from the square record jacket.

The objects, features and advantages of the present invention are readily apparent from the following detailed description of the preferred embodiments taken in connection with the accompanying drawings.

BEST MODE FOR CARRYING OUT THE INVENTION

Figure 1:
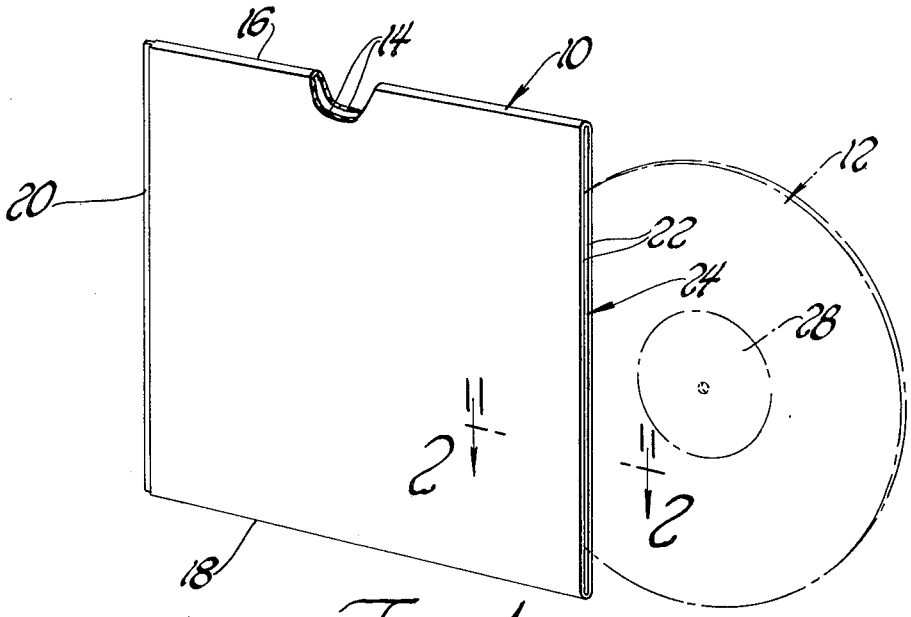
FIG. 1 is a partially broken-away perspective view of one embodiment of an antistatic phonograph record envelope constructed according to the present invention.

Referring to FIG. 1, one embodiment of an antistatic phonograph record envelope constructed according to the present invention is indicated generally by reference numeral 10 and is used to store a phonograph record 12 shown by phantom line representation. Envelope 10 has a generally square shape as shown and is made from a pair of layers 14 of extruded plastic film. Extruded tubular film is used to form the envelope 10 so that the layers 14 are joined at their upper and lower sides 16 and 18 without necessity of any seam. A suitable heat bond forms a seam 20 that extends between the upper and lower sides 16 and 18 to define a closed end of the envelope. Edges 22 of the plastic layers 14 extend alongside each other at an open end of the envelope to define an elongated slit 24 through which the record 12 is inserted into the envelope for storage and pulled out of the envelope for use. Slit 24 extends between the upper and lower envelope sides 16 and 18 which are spaced by a distance just slightly greater than the diameter of the record.

Figure 2:
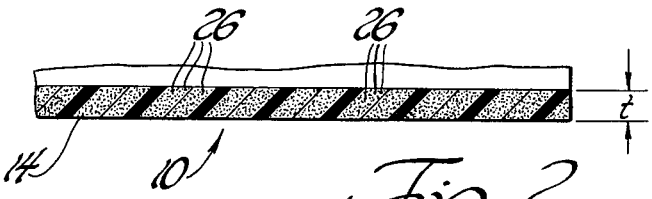
FIG. 2 is a sectional view through one plastic layer of the envelope taken along line 2—2 of FIG. 1 with the thickness of the layer greatly exaggerated for illustrative purposes.

With additional reference to FIG. 2, the extruded plastic film that forms the plastic layers 14 has a thickness t which is between about 1 and 6 mils, and which is preferably 2 mils for economy in the amount of plastic material necessary while concomitantly facilitating handling of the envelope during insertion of the record thereinto or during pulling of the record out for use. During storage, the plastic material of the envelope must be heavy enough to protect the record as it is inserted into a square cardboard jacket for storage. An internal antistatic agent in the form of minute electrically conductive particles 26, preferably carbon, are extruded within the plastic film dispersed uniformly throughout the film located at the surfaces thereof and between the surfaces. Carbon particles 26 lessen or completely eliminate any buildup of static electricity as the record 12 is moved through the slit 24 either during insertion of the record into the envelope for storage or during pulling of the record out of the envelope for use. During storage within the envelope 10, any static electricity which may have built up on the record 12 during use is dissipated by the carbon particles 26. These carbon particles 26 are soft and do not form any wear-producting projections at the inner surfaces of the layers 14 along which the oppositely facing record surfaces slide.

The plastic layers 14 of the record envelope 10 shown in FIGS. 1 and 2 can be provided with aligned central holes for permitting viewing of the record label 28. This enables the record once it is already inserted within the envelope to be checked for making sure it is subsequently inserted into the proper cardboard jacket for storage in case the person has forgotten which particular record is being handled. Plastic film of the type involved, i.e. those with an internal antistatic agent in the form of electrically conductive particles such as the carbon particles disclosed, are commercially available and the manner of manufacturing thereof will thus not be described.

Figure 3:
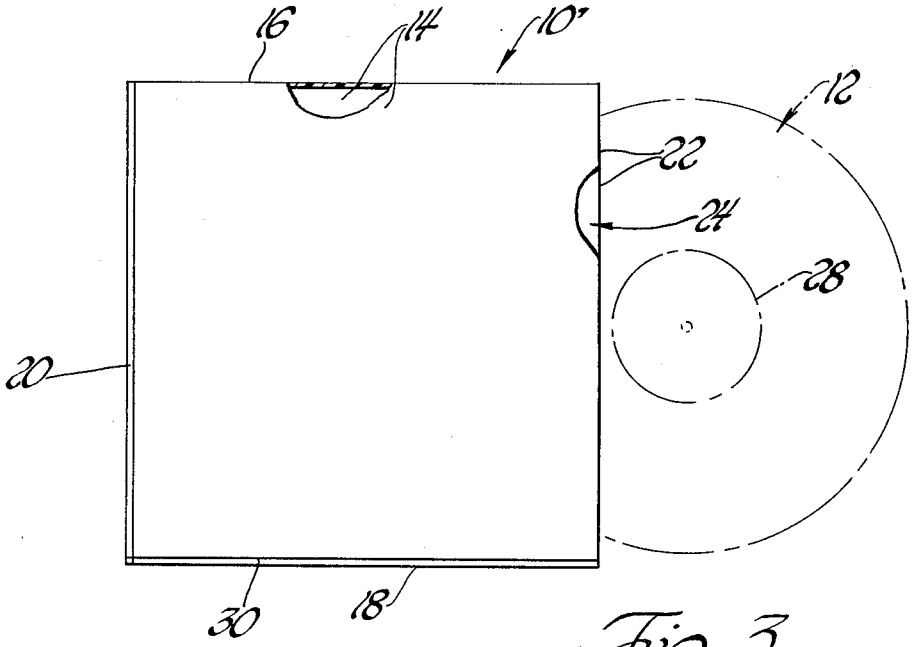
FIG. 3 is a side view of another antistatic phonograph record envelope that embodies the present invention and which is used to store a phonograph record shown by phantom line representation.

FIG. 3 shows another embodiment 10' of the antistatic record envelope which is similar to the envelope 10 previously described so that like reference numerals are applied thereto and much of the previous description applies except as will be noted. Rather than being formed from tubular extruded plastic film as with the other embodiment, envelope 10' is made from sheet film whose layers 14 are integrally joined only at their upper side 16 where a fold is made to form the two layers. A suitable bond such as a heat bond at the lower side 18 forms a seam 30 in the same way the closed end of the envelope has the seam 20 joining the layers 14. Movement of the record 12 into and out of the envelope 10' through the slit 24 at the open end between edges 22 thereof provides for storage of the record or use as desired. Static electricity buildup on the record is lessened or completely eliminated during this movement through the slit and any static electricity thereon is dissipated during the storage due to the internal antistatic agent in the form of the electrically conductive particles that are extruded within the plastic film in the same manner previously discussed.

Figure 4:
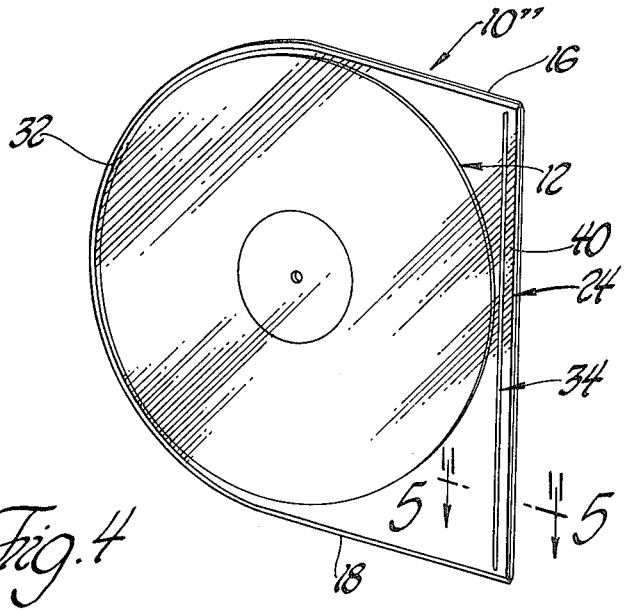
FIG. 4 is a perspective view of a further embodiment of an antistatic phonograph record envelope constructed according to this invention.
Figure 5:
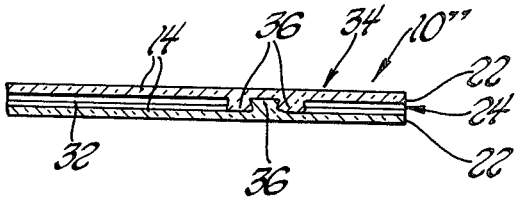
FIG. 5 is a sectional view taken through the open end of the envelope generally along line 5—5 of FIG. 4 so as to show a seal thereof.
Figure 7:
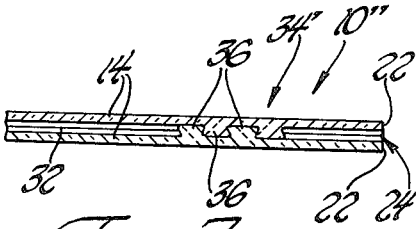
FIG. 7 is a sectional view similar to FIG. 5 showing a modified construction of the seal.

Referring to FIGS. 4 and 5 another embodiment of the antistatic record envelope is indicated generally by reference numeral 10'' and has reference numerals similar to the other embodiments designating like portions thereof. In this embodiment, the layers 14 of extruded plastic film having an internal antistatic agent are joined by a single continuous seam 32 which may be formed in a suitable manner such as by a heat bond. Seam 32 forms the upper and lower sides 16 and 18 of the envelope and also extends therebetween with a semicircular shape that forms the closed end of the record envelope. The diameter of the semicircular closed end of the record envelope is slightly greater than the diameter of the record 12 shown stored within the envelope. A seal 34 also extends between the upper and lower sides of the envelope at the open end thereof adjacent the slit 24 through which records are inserted. Seal 34 as can be seen in FIG. 5 includes projections 36 on the plastic layers 14. The projections 36 are snapped into engagement with each other as shown in FIG. 5 after insertion of a record so as to provide a seal that prevents dust and other accumulation from entering the envelope during storage of a record. Likewise, the seal prevents foreign matter from entering the envelope when the record is being played as well. Layers 14 are pulled away from each other at the open end of the envelope to pull the projections 36 out of engagement with each other in order to break the seal and permit insertion or removal of the record. A single projection 36 is shown on one of the layers 14 in FIG. 5 with two projections 36 shown on the other layers. However, it is to be understood that two of the projections 36 could be provided on each of the layers 14 as shown by the modified form of the seal 34' shown in FIG. 7. Likewise, other forms of the seal in which the plastic layers include projections for snapping into and out of engagement with each other can be provided.

The plastic material from which the layers 14 of the envelope 10'' are extruded can be polyethylene, polypropylene, polystyrene, ABS, SAN, and polyvinylchloride resins. Any conventional internal antistatic agent may be extruded within the plastic film to form the layers 14 and provide the antistatic characteristic which prevents the buildup of static charge as the record is inserted or removed from the envelope and which also dissipates any static charge during storage. For example, ethoxylated fatty amines work well with the polyethylene and polypropylene and are typically used with two moles of ethylene oxide per fatty amine chain utilizing either tallow or coconut oil as the oil source. Normally the internal antistatic agent extruded within the plastic film requires some time to bloom to the surfaces of the film to provide the antistatic properties. It should be noted that the internal antistatic agent utilized has advantages over external antistatic agents which are applied to the external surface in a thin surface film. Such external antistatic agents are easily washed off or removed by handling of the plastic film material. Insertion and removal of the record through the elongated slit 24 thus could cause removal of an external antistatic agent as opposed to the internal antistatic agent which provides permanent antistatic characteristics to the plastic material.

Figure 6:
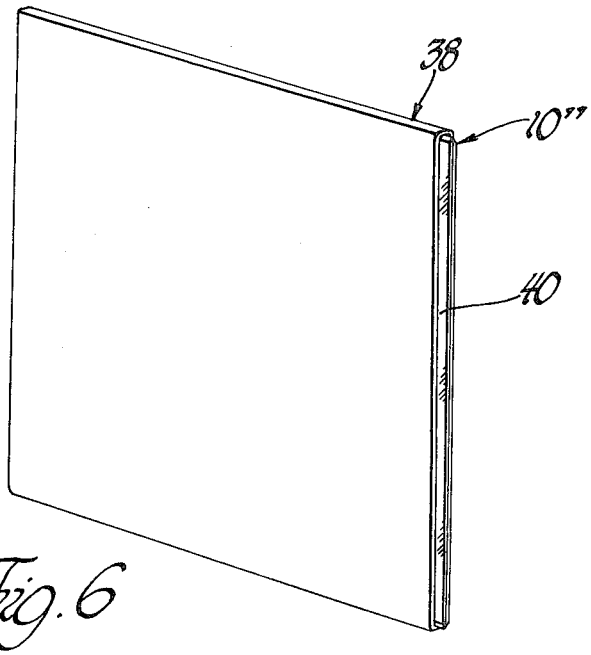
FIG. 6 shows the envelope of FIGS. 4 and 5 stored within a cardboard record jacket with a flap of the envelope projecting outwardly to facilitate removal of the envelope.

When the envelope 10'' is inserted into a square cardboard record jacket 38 as shown in FIG. 6, a flap 40 along the open end of the envelope projects outwardly from the jacket. Removal of the envelop 10'' from the jacket 38 is facilitated by the flap 40 which can be manually grasped without bending the jacket and causing possible damage to the stored record within the envelope. The maximum dimension between the open and closed ends of the envelope is slightly greater, i.e. on the order of ½ to ¾ of an inch, than the distance between the upper and lower sides of the envelope so as to provide the flap 40 which extends parallel with the seal 34 at the open end of the envelope.

Seal 34 shown in the FIGS. 4 through 7 embodiment can also be utilized with an envelope of the generally square type as shown in the FIGS. 1 through 3 embodiments. Likewise, the generally squares shapes of the record envelopes can be slightly elongated in one direction to provide the flap 40 for facilitating removal of the stored envelope from a cardboard record jacket in the manner described in connection with FIG. 6. Similarly, those skilled in this art will recognize various alternative designs and embodiments for altering the preferred embodiments disclosed to practice the present invention which is defined by the following claims.

What is claimed is:

1. An antistatic phonograph record envelope of a flat shape comprising a pair of plastic layers made from extruded plastic film having a thickness between about 1 and 6 mils between the surfaces thereof; an internal antistatic agent extruded within the plastic film layers between the surfaces thereof; at least one seam between the plastic layers; the envelope having a closed end and closed sides at which the layers are connected; the envelope having an open end extending between the closed sides at a location opposite the closed end; the plastic layers having edges that extend alongside each other at the open end to form an elongated slit through which a phonograph record is inserted into the envelope for storage and pulled out of the envelope for use whereby the antistatic agent in the plastic film layers mitigates the buildup of static electricity on the record as the record is inserted into and pulled out of the envelope and also dissipates any accumulated static electricity on the record during storage within the envelope; and the edges of the plastic layers at the open end of the envelope including a seal having cooperable projections which can be interengaged with each other to seal the envelope and store the record or which can be disengaged from each other to remove the stored record or to insert the record into the envelope for storage.

2. An antistatic phonograph record envelope of a flat shape comprising a pair of plastic layers made from extruded plastic film having a thickness of about 2 mils between the surfaces thereof; an internal antistatic agent extruded within the plastic film layers between the surfaces thereof; at least one seam between the plastic layers; the envelope having a closed end and closed sides at which the layers are connected; the envelope having an open end extending between the closed sides at a location opposite the closed end; the plastic layers having edges that extend alongside each other at the open end to form an elongated slit through which a phonograph record is inserted into the envelope for storage and pulled out of the envelope for use whereby the antistatic agent in the plastic film layers mitigates the buildup of static electricity on the record as the record is inserted into and pulled out of the envelope and also dissipates any accumulated static electricity on the record during storage within the envelope; the edges of the plastic layers at the open end of the envelope including a seal having cooperable projections which can be snapped into engagement with each other to close the envelope and store the record and which can be disengaged from each other to remove the stored record or to insert the record into the envelope for storage; and the envelope having a slightly greater maximum dimension between the open and closed ends thereof than the distance between the sides thereof such that the open end of the envelope provides a flap which is exposed when the envelope and stored record are inserted into a square record jacket so that the flap can be manually grasped to facilitate removal of the envelope and the record stored therein from the jacket.

3. An antistatic phonograph record envelope of a flat shape comprising a pair of plastic layers made from extruded plastic film having a thickness of about 2 mils between the surfaces thereof; an internal antistatic agent extruded within the plastic film layers between the surfaces thereof; at least one seam between the plastic layers; the envelope having a semicircular closed end and closed sides at which the layers are connected; the envelope having an open end extending between the sides at a location opposite the semicircular closed end; the plastic layers having edges that extend alongside each other at the open end to form an elongated slit through which a phonograph record is inserted into the envelope for storage and pulled out of the envelope for use whereby the antistatic agent in the plastic film layers mitigates the buildup of static electricity on the record as the record is inserted into and pulled out of the envelope and also dissipates any accumulated static electricity on the record during storage within the envelope; the edges of the plastic layers at the open end of the sleeve including a seal having cooperable projections which can be snapped into engagement with each other to close the envelope and store the record and which can be disengaged from each other to remove the stored record or to insert the record into the envelope for storage; and the envelope having a slightly greater maximum dimension between the semicircular closed end and the open end thereof than the distance between the sides thereof such that the open end of the envelope provides a flap which is exposed when the envelope and stored record are inserted into a square record jacket so that the flap can be manually grasped to facilitate removal of the envelope and the record stored therein from the jacket.

* * * * *